United States Patent [19]

Nimtz

[11] Patent Number: 5,064,178

[45] Date of Patent: Nov. 12, 1991

[54] MITERED FACE FOR THE JAWS OF A CLAMP, AND A CLAMP EMPLOYING A MITERED FACE

[75] Inventor: Roderick L. Nimtz, Garrettsville, Ohio

[73] Assignee: Warren Tool Corporation, Hiram, Ohio

[21] Appl. No.: 593,901

[22] Filed: Oct. 5, 1990

Related U.S. Application Data

[63] Continuation of Ser. No. 511,931, Apr. 16, 1990, Pat. No. 5,002,264.

[51] Int. Cl.[5] ..... B25B 1/24

[52] U.S. Cl. ..... 269/41; 269/197; 269/204; 269/252; 269/283; 269/902

[58] Field of Search ..... 269/41, 147, 269, 204, 269/279-284, 246, 250-252

[56] References Cited

U.S. PATENT DOCUMENTS

| | | | |
|---|---|---|---|
| 772,254 | 10/1904 | Rakweg | 269/147 |
| 1,781,997 | 11/1930 | Berezowski | 269/280 |
| 4,498,662 | 2/1985 | Halter | 269/283 |

*Primary Examiner*—Robert C. Watson

*Attorney, Agent, or Firm*—Lackenbach Siegel Marzullo & Aronson

[57] ABSTRACT

An assembly for the jaws of an article clamp. The assembly includes first body (23) receivable onto one jaw (11) of the clamp. The first body (23) has a first clamping face (25), and first support surface (26) to support the article. Fingers (31) are provided to removably secure the first body (23) to the one jaw (11) of the clamp. A second body (24) is receivable onto another jaw (12) of the clamp. The second body (24) has a second clamping face (27) cooperable with the first clamping face (25) to engage the article, and second support surfaces (28) to support the article. Fingers (31) also are provided to removably secure the second body (26) to the other jaw (12) of the clamp.

4 Claims, 2 Drawing Sheets

MITERED FACE FOR THE JAWS OF A CLAMP, AND A CLAMP EMPLOYING A MITERED FACE

This is a continuation divisional of copending application Ser. No. 7/511,931 filed on 4/16/90 now U.S. Pat. No. 5,002,269.

TECHNICAL FIELD

The present invention relates to a mitered face for the jaws of a clamp. More particularly, the present invention relates to a mitered face which, when attached to the jaws of a clamp, or when integrally formed therewith, permits clamping of mitered parts. The invention is also directed towards a clamping system, including clamp jaws employing a mitered face.

BACKGROUND ART

Pipe or bar clamps are commonly used to secure material while it is being worked upon, such as drilling, or while the pieces are joined, as by nailing, screwing or gluing. Such clamps generally consist of two opposing jaws, at least one of which is laterally adjustable with respect to the other. An interconnecting bar, pipe or other support is used to position the jaws in opposition to each other. Generally one jaw is lockably slidable along the interconnecting support, while the other jaw is adjustable by a continuous thread screw. One example of a clamp such as this is the HARGRAVE Clamp Fixtures, No. 600, manufactured by the Warren Tool Corporation of Hiram, Ohio. (HARGRAVE is a registered trademark of the Warren Tool Corporation, Hiram, Ohio).

In the past, the faces of these clamp jaws generally have been of a planar configuration. Such a configuration offers a wide range of possible uses; and renders the clamp usable with a variety of types, sizes or shapes of material. The jaws may be modified slightly to promote more efficient clamping, as for example, cutting cross-hatches in the opposing faces. The cross-hatches help the clamp to grip and secure the subject material better.

It should be appreciated that planar jaw faces are limited in use for either a single piece of material, or for two or more pieces of material, having surfaces which can be positioned so as to be substantially parallel with the jaw faces and normal to the clamping forces. Given any other positioning, the pieces of material are likely to be forced out of position by the clamp. For instance, the corners of a picture frame cannot easily be held together by a planar faced clamp. It has been necessary in the past, therefore, to create special purpose tools for such operations.

Picture frame clamps are known in the art, and generally hold all four corners of a frame squarely together. Such specialty tools are efficient, but serve only the one purpose for which they are manufactured. A picture frame clamp generally would not be useful for any operation other than framing. Because the need for clamping is widely varied, it is costly and time consuming to acquire a new tool for every clamping job.

The need therefore exists, for a clamping system having mitered jaw faces, to conform to tasks requiring other than parallel, planar clamping. Further, the need also exists for removable mitered clamp jaw faces, so as to permit the clamp to be adaptable to a wide variety of clamping situations, including the clamping of planar or mitered parts.

DISCLOSURE OF THE INVENTION

It is therefore, a primary object of the invention to provide a mitered face for the jaw of a clamp.

It is another object of the invention to provide a mitered face for the jaw of a clamp which is removable, so as to provide for the use of a variety of jaw faces.

It is a further object of the invention to provide a clamping system employing mitered jaw faces.

It is yet another object of the invention to provide a clamping system which can employ a wide variety of jaw faces, conforming to the task at hand.

These and other objects of the invention, as well as the advantages thereof over existing and prior art forms, which will become apparent in view of the following specification, are accomplished by means hereinafter described and claimed.

In general, an assembly for the jaws of an article clamp includes a first body receivable onto one jaw of the clamp. The first body has a first clamping face, and a first support surface to support the article. Means are provided to removably secure the first body to the one jaw of the clamp. A second body is receivable onto another jaw of the clamp. The second body has a second clamping face cooperable with the first clamping face to engage the article. A second support surface is also provided to support the article. Means are provided to removably secure the second body to the other jaw of the clamp.

EXEMPLARY EMBODIMENT FOR CARRYING OUT THE INVENTION

Figure 1:
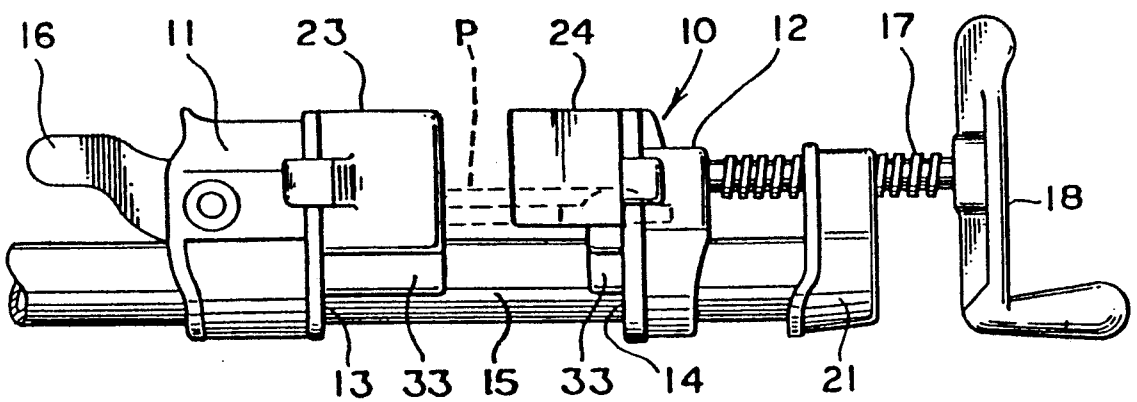
FIG. 1 is a side elevation view of a pipe clamp having mitered jaw inserts embodying the concept of the present invention.

A clamping system employing a mitered jaw face, according to the concept of the present invention, is indicated generally by the numeral 10 in FIG. 1 of the attached drawings. The clamp 10 consists of two opposing jaws 11 and 12, having jaw faces 13 and 14 respectively. An interconnecting bar 15 positions jaws 11 and 12 in alligned opposition. In the type of clamp depicted in the drawings, jaw 11 is slidable along interconnecting bar 15, and may be locked in place at the desired position by engaging locking lever 16 as is well known in the art. Opposing jaw 12 is adjustable relative to jaw 11 by a continuous screw 17 having a handle 18. Turning handle 18 causes screw 17 to move through the threaded opening of screw support 21 which is fixed to one end of bar 15. This in turn causes adjustment of jaw 12. It is noted that a clamp as thus far described herein is generally well known in the art. One such clamp is the HARGRAVE Clamp Fixture, No. 600 (HARGRAVE is a registered trademark of the Warren Tool Corporation, Hiram, Ohio.) The present invention, however, is usable with a wide variety of clamps. A specific clamp has been described herein for illustrative purposes only, and is not intended to be a limitation of the invention.

Figure 3:
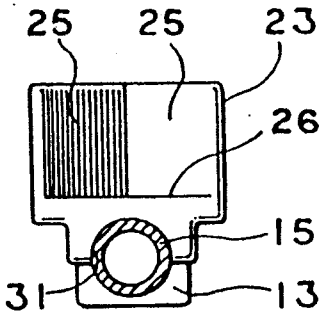
FIG. 3 is a cross-section taken substantially along line 3—3 of FIG. 2.
Figure 2:
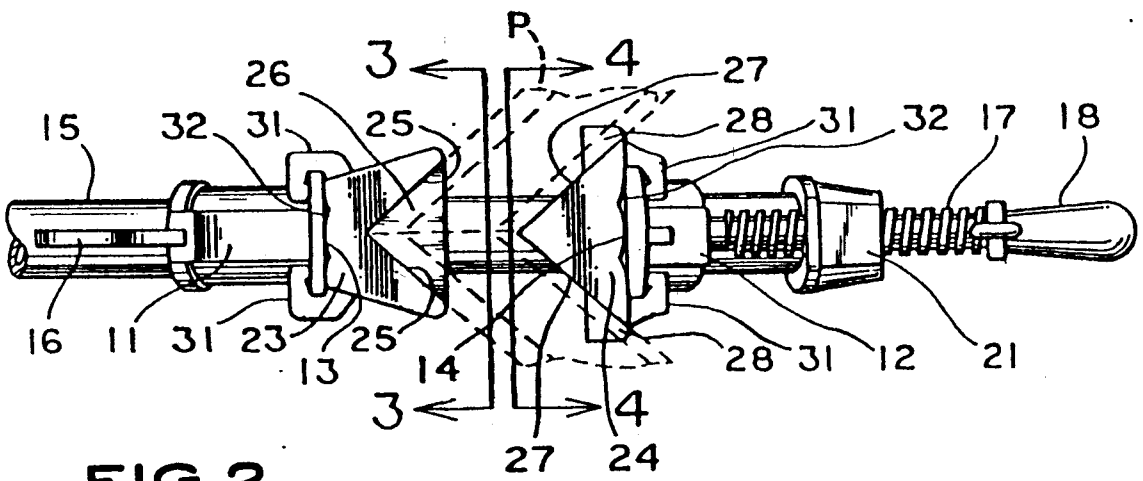
FIG. 2 is a top plan view of the clamp of FIG. 1.
Figure 5:
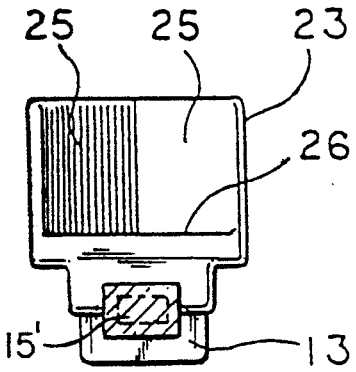
FIG. 5 is a cross-section taken substantially along line 3—3 of FIG. 2 and showing another embodiment of an interconnecting bar.
Figure 6:
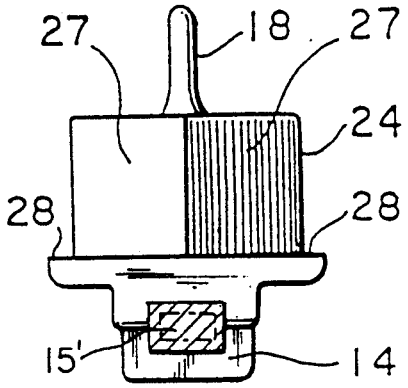
FIG. 6 is a cross-section taken substantially along line 4—4 of FIG. 2 and showing another embodiment of the interconnecting bar.
Figure 7:
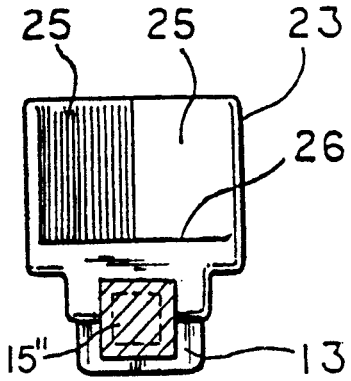
FIG. 7 is a cross-section taken substantially along line 3—3 of FIG. 2 and showing a further embodiment of the interconnecting bar.
Figure 8:
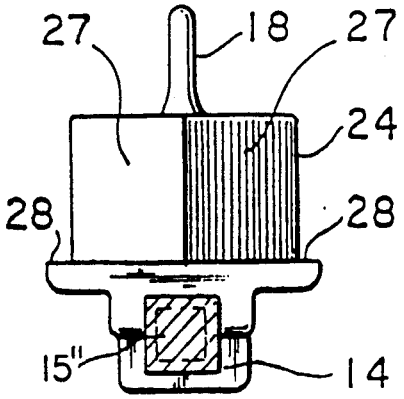
FIG. 8 is a cross-section taken substantially along line 4—4 of FIG. 2 and showing a further embodiment of the interconnecting bar.

Jaw faces 13 and 14 are fitted with a mitered insert assembly having first and second body parts, 23 and 24, repsectively, as depicted in FIGS. 1 and 2. First body part 23 defines a female member, which is in opposition to second body part 24, defining a male member. These configurations are best depicted in FIG. 2. First body part 23 has a pair of upstanding walls 25, as depicted in FIG. 3, diverging at a predetermined angle forming an interior mitered region. An interior support surface 26 bridges walls 25 at the lowermost region thereof, as depicted in FIG. 3. Support surface 26 provides suitable support to receive work pieces being clamped, as will be discussed hereinafter.

Figure 4:
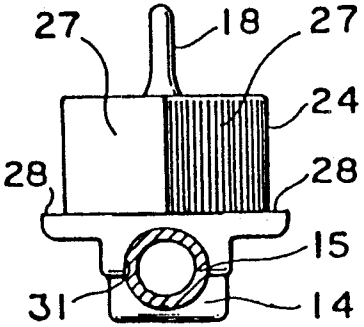
FIG. 4 is a cross-section taken substantially along line 4—4 of FIG. 2.

Second body part 24 likewise has a pair of complementary upstanding walls 27 as depicted in FIG. 4, converging preferably at the same angle as first body part walls 25, and forming an exterior mitered region. Exterior support surfaces 28 depend outwardly from each wall 27 at the lowermost regions thereof. As with interior support surface 26, exterior support surfaces 28 each provide suitable support to receive a work piece being clamped. As such, to facilitate alignment and clamping of the work pieces, it is desirable that interior support surface 26 and exterior support surfaces 28 all be positioned in the same horizontal plane.

It is to be appreciated that the angular orientation of upstanding walls, 25 and 27, may be of any angle desired. The angle disclosed in the present embodiment is approximately 90°. Such a mitered face would be useful in clamping the corner of a picture frame or the like, which forms a 90° joint. Each body part, 23 and 24, may be removably secured to its respective jaw 11 and 12 of the clamp 10.

As depicted in FIG. 2, first and second body parts, 23 and 24, each have integrally formed fingers 31 extending from the rear surface 32 of each body part, 23 and 24. Fingers 31 are suitably configured to embrace the respective jaw, 11 and 12, in a relatively snug manner with rear surface 32 in juxtaposition with the corresponding jaw face, 13 and 14, respectively. While such an embodiment provides a suitable arrangement for removably securing the material body parts to the respective jaws, it is contemplated that other fastening techniques may be employed. Depending, in part, on the configuration of the clamp jaws, the mitered body parts may be secured using suitable fasteners, such as screws, pins, clips and the like.

Providing additional positioning support to the body part is saddle 33. As can best be seen in FIG. 3 and FIG. 4, saddle 33 is positioned at the base of each body part, 23 and 24, and is configured suitably to engage interconnecting bar 15. In the embodiment disclosed herein, saddle 33 is semi-circular so as to conform to the cylindrical shape of interconnecting bar 15. It should be appreciated that as the interconnecting bar 15 may have various sectional configurations, such as square and triangular, saddle 33 should be suitably configured to conform with connecting bar 15 of a particular clamp 10.

The structure of the present invention may be more fully understood and appreciated by considering the operation of a clamping system employing the same. With reference to FIGS. 1 and 2, the clamping system 10 may be considered while performing a clamping function on a mitered work piece, depicted in broken lines and indicated as P. Specifically, the work piece P includes a pair of mitered pieces each of which has been cut and prepared to form a mitered joint, as would be known to one skilled in the art.

The individual pieces of the work piece P are positioned between the opened jaws, 11 and 12, of the clamp 10 which have mitered body parts, 23 and 24, secured thereon. The work piece P is placed onto interior support surface 26 of first body part 23 and onto exterior support surfaces 28 of second body part 24 to facilitate alignment of the work piece P. Once the work piece P is properly aligned with the mitered surfaces in abutment with each other, handle 18 and screw 17 are manipulated to move jaw 12 with second body part 24 toward jaw 11 with first body part 23 thereon. In this fashion, the work piece P will be clamped between corresponding upright walls 25 and 27 of first body part 23 and second body part 24, respectively.

It should be appreciated that the clamping force generated by jaw 12 and second body part 24 is along the axis of bar 15 and not merely normal to the angled upright walls 27, as is the case with many prior art clamps. As such, the individual pieces of the work piece P are forced into the interior mitered region of first body part 23 which, in turn, forces the individual pieces into tight abutment with each other along the respective mitered surfaces. The work piece P, thus, is assured of having a very good and precise mitered joint.

With the present invention as heretofore described, mitered joints of many different sizes can be clamped. Indeed, it has been found that the size of the work pieces which may be clamped using the present invention is limited, for the most part, by the length of interconnecting bar 15.

It also should be appreciated that a clamp according to the present invention is usable for various clamping situations. In addition to the clamping operation heretofore described, the clamp 10 of the present invention may be used in a more conventional manner. Specifically, mitered body parts, 23 and 24, may be removed and a work piece can be clamped directly between jaw faces 13 and 14, as is well known in the art. Likewise, mitered body parts, 23 and 24, can be replaced with other body parts suitable for other clamping functions—such as clamping round objects or objects mitered at angles other than 90°.

It should be evident, in view of the foregoing, that a mitered face for the jaws of a clamp, and a clamp employing a mitered face, embodying the concept of the invention disclosed herein carries out the various objects of the invention and otherwise constitutes an advantageous contribution to the art.

I claim:

1. A clamping assembly for clamping articles, such as a work piece, comprising a linear bar having polygonal cross-section;

opposed first and second jaw means having first and second bases, each said first and second bases having an inside area adapted for slidable engagement with said linear bar;

said linear bar slidably supporting said first and second bases of said first and second jaw means through said inside areas thereof;

means for locking and unlocking said first jaw means in a predetermined position on said linear bar;

means for applying and relieving pressure on the work piece by linearly advancing said second jaw means on said bar toward and away from said first jaw means;

said first and second jaw means further comprising first and second jaw faces extending from said first and second bases;

first and second clamp bodies for receiving a work piece therebetween, said first clamp body having a first mitered face and a third base connected to each other, said second clamp body having a second mitered face and a fourth base attached to each other, each said third and fourth bases having an inside area with substantially 180° polygonal configuration which is adapted for slidable engagement with said linear bar;

said first and second mitered faces are matching each other, said first mitered face is removably connected to said first jaw face in such a manner that said third base is slidably supported by said linear bar through said inside area of the third base, said second mitered face is removably connected to said second jaw face in such a manner that said fourth base is slidably supported by said linear bar through said inside area of the fourth base, wherein said linear bar, and said inside areas of said first, second, third and fourth bases have a common longitudinal axis.

2. A clamp assembly according to claim 1, wherein each said clamp body has curved fingers slidably embracing peripheries of the corresponding jaw face.

3. A clamp assembly according to claim 1, wherein said polygonal cross-section of the linear bar is a rectangle.

4. A clamp assembly according to claim 1, wherein said polygonal cross-section of the linear bar is a square.

* * * * *